United States Patent [19]

Peil et al.

[11] Patent Number: 4,877,217

[45] Date of Patent: Oct. 31, 1989

[54] FAIL-SAFE BLOWOUT PREVENTER

[75] Inventors: Archie W. Peil; Thomas R. Bishop, both of Houston, Tex.

[73] Assignee: Bowen Tools, Inc., Houston, Tex.

[21] Appl. No.: 263,519

[22] Filed: Oct. 27, 1988

[51] Int. Cl.[4] ..... F16K 31/00

[52] U.S. Cl. ..... 251/1.3; 92/130 A; 91/415

[58] Field of Search ..... 251/1.1, 1.3; 92/130 A; 91/415, 416

[56] References Cited

U.S. PATENT DOCUMENTS

Re. 18,874 6/1933 Abercrombie ..... 251/1.3 X 3,122,065 2/1964 Laun ..... 251/62 X

*Primary Examiner*—John Fox

*Attorney, Agent, or Firm*—B. R. Pravel

[57] ABSTRACT

A fail-safe mechanism for closing the rams in a conventional blowout preventer. The mechanism includes a ram shaft having an enlarged outer end that is exposed to well pressure which exerts a constant closing force. The closing force is opposed by a hydraulic fluid chamber which is evacuated in the event of fire, etc. A floating plug within the ram shaft helps prevent leaks of well fluid from the blowout preventer.

20 Claims, 2 Drawing Sheets

FAIL-SAFE BLOWOUT PREVENTER

FIELD OF THE INVENTION

The invention relates to blowout preventers for oil wells, and more particularly to such preventers that are closed by well pressure.

BACKGROUND OF THE INVENTION

U.S. Pat. Nos. 1,533,404 and 1,834,063 illustrate blowout preventers which use well pressure to close the well bore. Both patents divert a portion of the well flow within the well bore behind a piston that is connected to a ram which closes the well bore. The cross-sectional area of the piston exposed to the well fluid is larger than the cross-sectional area of the ram shaft exposed to the well fluid and results in a closing force sufficient to close the well bore. Closing of the rams by well pressure requires an external mechanism to open the rams, and is commonly termed "fail-safe" operation because the rams can be closed when the external mechanism fails. U.S. Pat. No. 1,834,063 further describes a separate mechanism for opening and closing the rams by injecting steam, air, or gas on either side of the piston.

U.S. Pat. Nos. 3,036,807 and 4,582,293 describe blowout preventers having balanced rams and ram stems achieved by allowing well pressure behind the ram and behind the ram stem. Pistons connected to the ram stems allow operation of the rams by injecting a hydraulic fluid on either side of the piston. Failure of the hydraulic fluid system makes the blowout preventers inoperable. U.S. Pat. No. 4,582,293 further describes a floating plug in an axial bore of a ram shaft to maintain an essentially constant volume of grease in contact with the outer moving parts of the ram shaft.

SUMMARY OF THE INVENTION

This invention relates to a fail-safe mechanism for closing a blowout preventer having a ram bore for guiding a balanced ram between an open and a closed position, wherein the ram shaft has an inner end and an outer end, with the inner end having a smaller cross sectional area than the outer end, and the outer end having a smaller cross sectional area than the ram, so that well pressure constantly exerts a force upon the outer end of the ram shaft to constantly urge the ram towards the closed position which occurs in the event of reduction in the force normally holding the ram in the open position.

Another aspect of the invention involves a plug slidably mounted in an enlarged portion of an axial bore in the ram shaft to maintain fluid in operable contact with the outer moving parts of the ram shaft at an essentially constant volume even though the well pressure varies. Inadvertent loss of such fluid causes the plug to move outwardly so as to seal the axial bore in the ram shaft to prevent continous loss of well fluid.

DETAILED DESCRIPTION OF THE INVENTION

Figure 1:
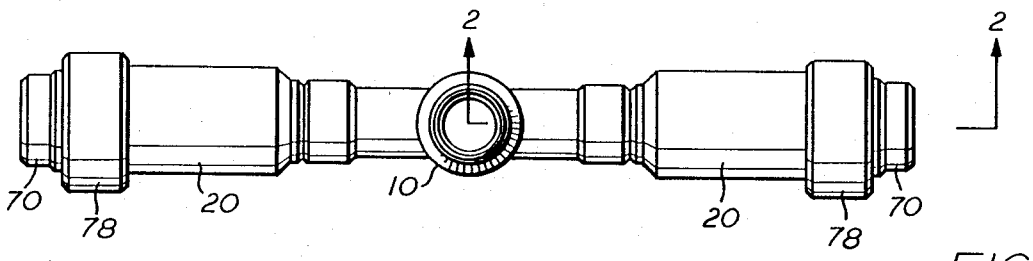
FIG. 1 illustrates two opposing fail-safe mechanisms on a conventional blowout preventer body.

The fail-safe mechanism described below is attached to a conventional blowout preventer body 10 having a longitudinal bore 12 and a ram bore 14 perpendicular to the bore 12. The bore 12 is longitudinally aligned with the well bore. The body 10 is connected by threads **10*a* or other suitable means at its upper end to well pipe (not shown) extending thereabove to the surface, and by welding or other suitable means at its lower end 10*b* to well pipe (not shown) extending downwardly to the well. A conventional balanced ram 16 is mounted in the ram bore 14 and is moved between an open position (FIG. 2) and a closed position (FIG. 3) as described in detail below. The ram 16 is balanced because a channel 18 in the ram bore 14 of the blowout preventer body 10 allows well fluid to pass behind the ram 16 to counteract the well pressure acting outwardly upon the ram 16**.

Fail-Safe Mechanism

The fail-safe mechanism has a housing 20 which is mounted to the preventer body 10 by threads 21 or other suitable fastening means. The housing 20 has a bore 22 in one end adjacent the preventer body 10. The bore 22 extends from the ram bore 14 to a chamber 24 in the housing 20. A ram shaft 26 extends through the bore 22 and is connected by threads 27 or other suitable means to a collar 28. The collar 28 joins the ram 16 to the ram shaft 26 in the usual way by the collar fitting in a recess **16*a*. A first seal 30 and a second seal 32, preferably O-rings, are positioned between the ram shaft 26 and the bore 22 to prevent flow or leaks of the well fluid from the ram bore 14 or of hydraulic fluid from the chamber 24. A leak indicator port 34, which communicates with an annular chamber 35 in the bore 22 between the first seal 30 and the second seal 32 provides for fluid leakage externally of the body 20 which can be visually observed if either of the seals 30 and 32** becomes defective.

A piston 36 is either integrally formed with the ram shaft 26 or is connected by suitable connecting means. The piston 36 reciprocates within chamber 24 of the housing 20. Two seals 38, preferably O-rings, are positioned between the piston 36 and the housing 20 to prevent flow or leaks of fluid from one side of the piston 36 to the other.

Figure 2:
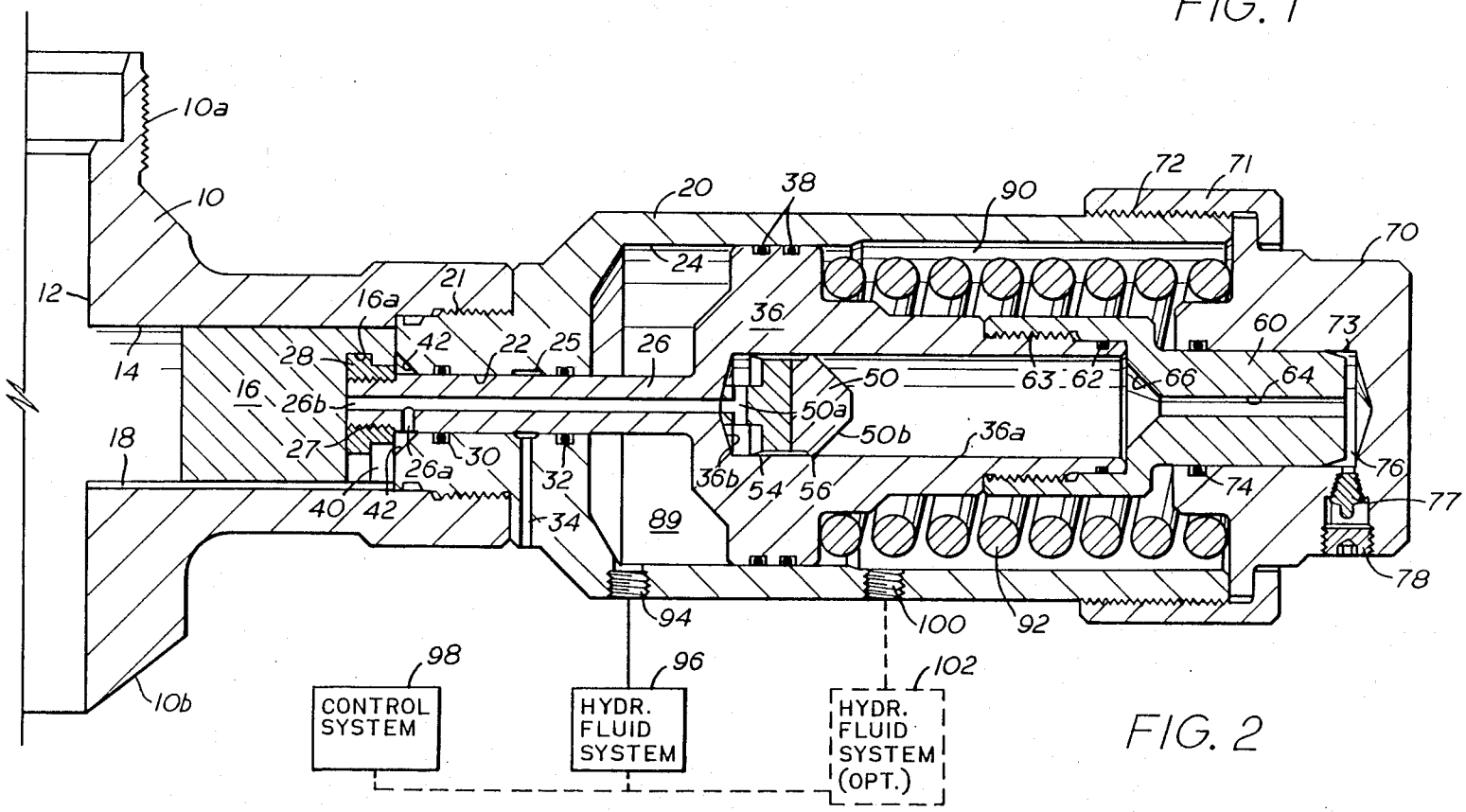
FIG. 2, a cross sectional view taken on line 2—2 of FIG. 1, shows the internal components of a fail-safe mechanism holding a conventional ram in the open position.

When the ram 16 is in the open position (FIG. 2), well fluid bypasses the ram 16 through the channel 18 in the preventer body 10 and through a notch 40 in the ram 16 below the collar 28. The well fluid then enters a countersunk portion 42 of the bore 22 in the housing 20 which directs the well fluid to a lateral hole **26*a* in the ram shaft 26. The hole 26*a* in the ram shaft 26 extends from the outer surface of the ram shaft 26 to an axial bore 26*b* in the ram shaft 26. The axial bore 26*b* in the ram shaft 26 conducts the well fluid to an enlarged bore 36*a* within the piston 36. A plug 50 is slidably mounted within the enlarged bore 36*a*. The plug 50 has a T-shaped passage 50*a* for directing well fluid behind (to the left as viewed in FIG. 2) the plug 50 when the plug contacts the surface 36*b* of the piston 36 as shown in FIG. 2**.

When the ram 16 is moved to the closed position (FIG. 3), the well fluid passes from the channel 18 in the preventer body 10 into the area 45 in the ram bore 14 behind (to the right as viewed in FIG. 2) the ram 16 prior to entering the hole 26*a* in the ram shaft 26. The well fluid moves the plug 50 which has unidirection seals 54 and 56 preferably made of a resilient material such as rubber that prevent fluid from bypassing the plug in the direction from seal 54 to seal 56. Fluid can bypass the plug in the direction from seal 56 to seal 54 when the plug 50 is at rest contacting surface 36*b* of the piston 36 adjacent axial bore 26*b* of the ram shaft 26 as explained more fully below.

An overbalance piston 60 is connected to the piston 36 with threads 63 or other suitable connecting means. A seal 62, preferably an O-ring, is positioned between the piston 60 and the piston 36. The overbalance piston 60 essentially forms the outer end of the ram shaft 26 opposite the ram 16. The overbalance piston 60 has an axial bore 64 which has a tapered annular portion 66 for receiving a similarly tapered end 50*b* of the plug 50 for reasons described below.

A cap 70 is mounted with the housing 20 by a locking ring 71. The locking ring 71 slips over the cap 70 and engages the housing 20 by threads 72 or other suitable means. The cap 70 has a central bore 73 for receiving the overbalance piston 60. A seal 74, preferably an O-ring, is positioned between the overbalance piston 60 and the cap 70 to reduce leaks of fluid from a chamber 76 that is formed between the overbalance piston 60 and the cap 70.

A fluid injection fitting 77 is positioned at the end of the chamber 76 for injecting a fluid into the chamber 76. A removable plug 78 seals the opening to fittings 77. While the ram 16 is in the open position (FIG. 2), fluid can be injected into the chamber 76 causing the plug 50 to move into contact with the end 36*b* of the axial bore 36*a* which is the seated position for the plug 50. Damage from injection of excessive fluids is prevented or minimized by allowing the fluid to bypass the unidirection seals 54, 56 on the plug 50. Following injection of fluid through port 77, the port 77 is sealed by the threaded plug 78. If any leakage of fluid occurs around the threaded plug 78, or the seals 62 and 74, the plug 50 will be moved towards the countersunk portion 66 of the axial bore 64 in the overbalance piston 60 by the well pressure from the bore 12. If the extent of such leakage is great enough to cause the plug 50 to engage and thus seal within the countersunk portion 66, further leaks are stopped.

The fluid injected through port 77 into the chamber 76 can be a portion of the well fluid or a noncompressable grease or other fluid which is less corrosive than well fluids.

If desired, the overbalance piston 60 can have an optional indicator stem 80 (shown in FIG. 3) which extends through the cap 70 to allow visual determination of the position of the ram 16. A seal 82, preferably an O-ring, is positioned between the indicator stem 80 and the cap 70 to reduce leaks from the chamber 76 which leaks may also cause the plug 50 to seal against the countersunk portion 66 of the axial bore 64 in the overbalance piston 60. A sleeve 84 having a bore 86 is connected to the cap 70 to protect the indicator stem 80 while in the extended position. The indicator stem 80 also has T-shaped bore 88 which is an extension of the axial bore 64 for transmitting fluid from the axial bore 64 to the chamber 76 when the indicator stem 80 is used.

The cross-sectional area of the overbalance piston 60 at seal 74, which is essentially the outer end of the ram shaft, is larger than the cross-sectional area of the inner end of the ram shaft 26 at seal 30 and results in a constant closing force on the ram 16 even though the cross-sectional area of the overbalance piston 60 is less than the cross-sectional area of the ram 16. The closing force on the outer end of the ram shaft is calculated by multiplying the pressure of the fluid in chamber 76 by the cross-sectional area of the overbalance piston 60 at seal 74. The opposing force on the inner end of the ram shaft is calculated by multiplying the pressure of the fluid in the well bore, which is essentially the same as the pressure in chamber 76 since plug 50 is free-floating, by the cross-sectional area of the ram shaft 26 at seal 30 since the well fluid is present on both sides of the ram 16 as previously described.

Movement of the ram shaft 26 and ram 16 to the closed position (FIG. 3), is by a hydraulic fluid system as will be explained. When such movement occurs, the plug 50 moves towards the overbalance piston 60 a sufficient distance to compensate for the increased volume in chamber 76 caused by the movement of piston 36 from the right to the left, thereby maintaining a constant volume of fluid on the side of the plug 50 in communication with the chamber 76. During normal operation, the plug 50 does not reach the countersunk portion 66 of the axial bore 64 within the overbalance piston 60 so that well pressure is continually the same in the well bore 14 and the chamber 76. Although small leaks of the fluid from chamber 76 may cause sufficient movement of the plug 50 towards the counterbalance piston 60 to prevent operation of the fail-safe mechanism, such leaks can be avoided by regular maintenance or counteracted by periodic injection of fluid through port 77 to insure that plug 50 remains in an operative position at all times.

Hydraulic Fluid System

The piston 36 on the ram shaft 26 divides the chamber 24 of the housing 20 into a first chamber 89 and a second chamber 90. In the preferred embodiment, a hydraulic oil is maintained under pressure in the first chamber 89 while the ram 16 is in the open position (FIG. 2). The hydraulic fluid counteracts the closing forces on the ram 16 and evacuation of the hydraulic fluid from the chamber 89 results in the closing of the ram 16. An optional coil spring 92 can be positioned in the chamber 90 to assist in closing of the ram 16 when the pressure of the well fluid is not sufficient to provide fast closing of the ram 16. Well pressures above 500 pounds per square inch are expected to be sufficient to close conventional rams 16 without the assistance of the coil spring 92. With the present invention, it is important that the closing force is the well pressure. Springs cannot be relied upon for closing the rams due to the high force required to effect a seal between the rams in the well.

The ram 16 is moved to the open position (FIG. 2) by pumping the hydraulic fluid through port 94 into the first chamber 89 using a conventional hydraulic fluid system 96 capable of delivering hydraulic fluid at a predetermined pressure. The hydraulic fluid system 96 is controlled by a conventional control system 98 which can generate an external signal that instructs the hydraulic fluid system 96 to evacuate the first chamber 89 in the event of various problems such as fire, loss of well pressure, etc.

The second chamber 90 is preferably vented to the atmosphere through a vent 100. Alternatively, the vent 100 can be tapped for connection to a hydraulic fluid system 102 which can be operated by the control system 98 to assist in closing the ram 16 when the well pressure is low or when the fail-safe mechanism is inoperative.

Operation

Figure 3:
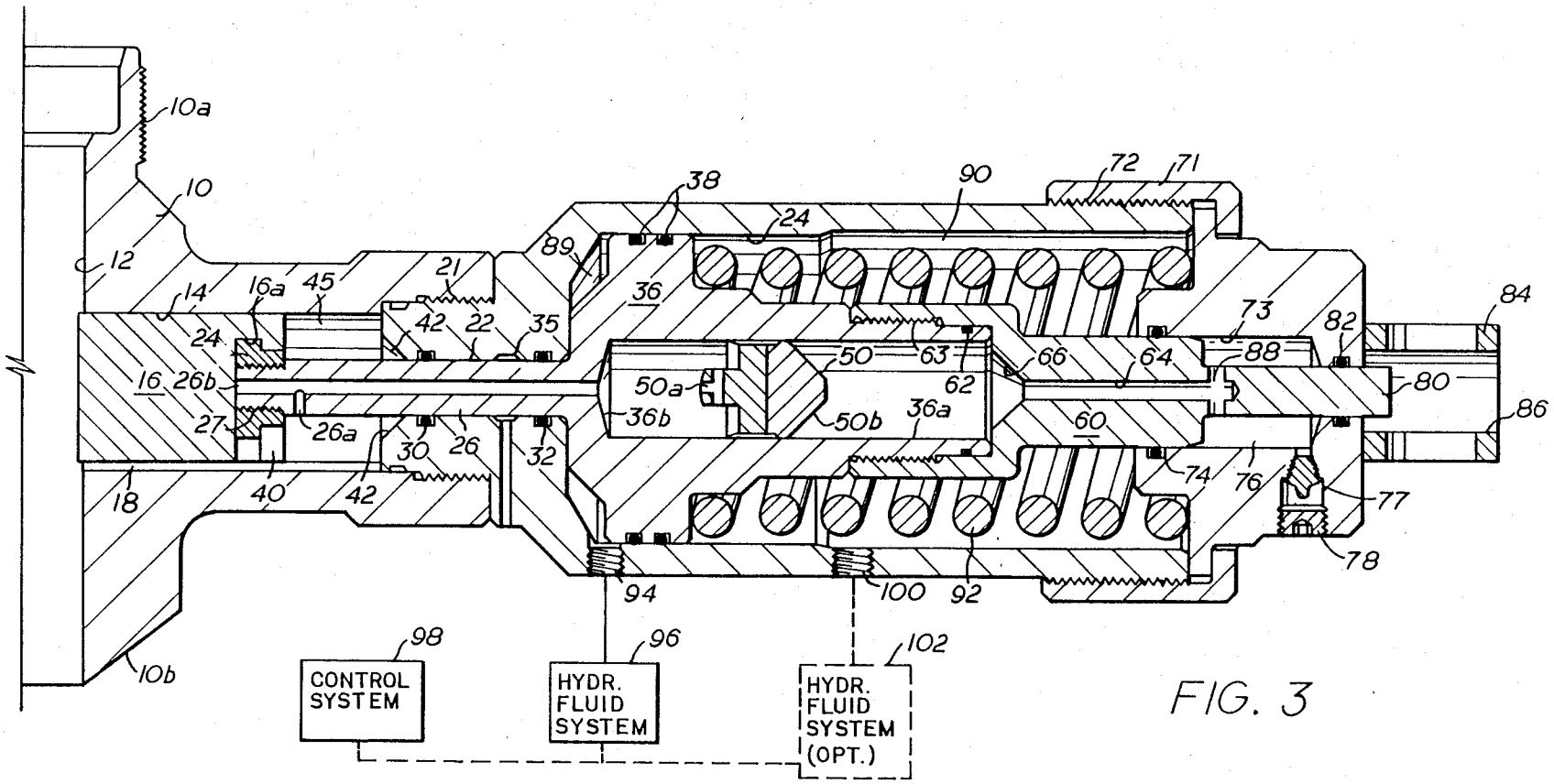
FIG. 3 illustrates the fail-safe mechanism of FIG. 2 with an alternative indicating stem and with the ram moved to the closed position.

While the ram 16 is in the open position shown in FIG. 2, the closing force generated by the fail-safe mechanism is counteracted by the force of the hydraulic fluid in the chamber 89. The latter force is calculated by multiplying the pressure of the hydraulic fluid in chamber 89 by the difference between the cross-sectional areas of the piston 36 and the ram shaft 26. The mechanism is considered to be fail-safe because a failure of the hydraulic fluid system 96 which causes a loss of hydraulic fluid from the chamber 89 will result in closing of the ram 16 as previously described as long as the fail-safe mechanism is operative. The fail-safe mechanism may become inoperative by loss of fluid from the chamber 76 which permits the plug 50 to contact the countersunk portion 66 of the axial bore 64 within the overbalance piston 60 either prior to the loss of hydraulic fluid from the chamber 89 or while the ram 16 is moving from the open position (FIG. 2) to the closed position (FIG. 3).

The force of the well fluid on the outer end of the ram shaft, which is also called the overbalance piston 60, is sufficient to close the ram 16 even through the cross-sectional area of the overbalance piston 60 is less than the cross-sectional area of the ram 16. The force of the well fluid pushing outwardly against the ram 16 (to the right in FIGS. 2 and 3) is balanced by the force of the well fluid contained in the area behind the ram 45. As a result, the cross-sectional area of the overbalance piston 60 need only be greater than the cross-sectional area of the ram shaft 26 to provide a constant closing force on the ram 16. Sufficient closing force is obtained with a cross-sectional area of the overbalance piston 60 that is less than the cross-sectional area of the ram 16.

Although the loss of fluid from the chamber 76 may make the fail-safe mechanism inoperative, such a loss of fluid can be avoided by periodic maintenance or periodic injection of fluid through port 77 to maintain the plug 50 in the ready position. Further, it is preferred that a blow-out preventer which closes by well pressure be inoperative rather than continually leak fluid to the environment.

The foregoing disclosure and description of the invention are illustrative and explanatory thereof, and various changes in the size, shape and materials, as well as in the details of the illustrated construction may be made without departing from the spirit of the invention.

What is claimed:

1. A fail-safe mechanism for closing a blowout preventer in response to an external signal, the blowout preventer comprising a preventer body having a ram bore for guiding a balanced ram between an open and a closed position, the mechanism comprising:

a ram shaft having an inner end and an outer end, the cross-sectional area of the inner end being smaller than the cross-sectional area of the outer end, and the cross-sectional area of the outer end being smaller than the cross-sectional area of the ram;

means for allowing fluid within the ram bore to exert a force upon the cross-sectional area of the outer end of the ram shaft for urging the ram to the closed position; and means for opposing movement of the ram from the open to the closed position until the external signal is received.

2. The fail-safe mechanism of claim 1, wherein the means for opposing movement of the ram comprises:

a piston connected to the ram shaft between the inner and the outer ends;

a housing forming a chamber around the ram shaft between the piston and the inner end of the ram shaft; and means for holding a hydraulic fluid in the chamber until the external signal is received.

3. The fail-safe mechanism of claim 2, further comprising a spring that rests against the piston to help urge the ram to the closed position.

4. The fail-safe mechanism of claim 1, wherein the means for allowing fluid within the ram bore to exert a force on the outer end of the ram shaft comprises:

an axial bore in the ram shaft extending from the ram bore to a chamber adjacent the outer end of the ram shaft; and a plug slidably mounted in an enlarged portion of the axial bore to seal the axial bore when fluid leaks from the chamber.

5. A fail-safe mechanism for closing a blowout preventer in response to an external signal, the blowout preventer comprising a preventer body having a ram bore for guiding a balanced ram between an open and a closed position, the mechanism comprising:

a ram shaft having:

an inner end and an outer end, the cross-sectional area of the inner end being smaller than the cross-sectional area of the outer end, and the cross-sectional area of the outer end being smaller than the cross-sectional area of the ram;

an axial bore extending from the ram bore to a chamber adjacent the outer end of the ram shaft; and a plug slidably mounted in an enlarged portion of the axial bore to seal the axial bore when fluid leaks from the chamber;

means for opposing movement of the ram from the open to the closed position until the external signal is received; and a spring that helps urge the ram to the closed position.

6. The fail-safe mechanism of claim 5, wherein the means for opposing movement of the ram comprises:

a piston connected to the ram shaft between the inner and the outer ends;

a housing forming a second chamber around the ram shaft between the piston and the inner end of the ram shaft; and means for holding a hydraulic fluid in the second chamber until the external signal is received.

7. A fail-safe blowout preventer, comprising:

a preventer body having a ram bore for guiding a ram between an open and a closed position;

means for allowing fluid within the ram bore to bypass the ram;

a ram shaft having an inner end and an outer end, the cross-sectional area of the inner end being smaller than the cross-sectional area of the outer end, and the cross-sectional area of the outer end being smaller than the cross-sectional area of the ram;

means for allowing fluid within the ram bore to exert a force upon the cross-sectional area of the outer end of the ram shaft for urging the ram to the closed position; and means for opposing movement of the ram from the open to the closed position until an external signal is received.

8. The fail-safe blowout preventer of claim 7, wherein the means for opposing movement of the ram comprises:

a piston connected to the ram shaft between the inner and the outer ends;

a housing forming a chamber around the ram shaft between the piston and the inner end of the ram shaft; and means for holding a hydraulic fluid in the chamber until the external signal is received.

9. The fail-safe blowout preventer of claim 8, further comprising a spring that rests against the piston to help urge the ram to the closed position.

10. The fail-safe blowout preventer of claim 7, further comprising means for generating the external signal.

11. A fail-safe blowout preventer, comprising:

a preventer body having a ram bore for guiding a ram between an open and a closed position;

means for allowing fluid within the ram bore to bypass the ram;

a ram shaft having:

an inner end and an outer end, the cross-sectional area of the inner end being smaller than the cross-sectional area of the outer end, and the cross-sectional area of the outer end being smaller than the cross-sectional area of the ram;

an axial bore extending from the ram bore to a chamber adjacent the outer end of the ram shaft; and a plug slidably mounted in an enlarged portion of the axial bore to seal the axial bore when fluid leaks from the chamber;

means for opposing movement of the ram from the open to the closed position until an external signal is received; and a spring that helps urge the ram to the closed position.

12. The fail-safe blowout preventer of claim 11, wherein the means for opposing movement of the ram comprises:

a piston connected to the ram shaft between the inner and the outer ends;

a housing forming a second chamber around the ram shaft between the piston and the inner end of the ram shaft; and means for holding a hydraulic fluid in the second chamber until the external signal is received.

13. The fail-safe blowout preventer of claim 12, further comprising means for generating the external signal.

14. A fail-safe blowout preventer, comprising:

a preventer body having a ram bore for guiding a ram between an open and a closed position;

means for allowing fluid within the ram bore to bypass the ram;

a ram shaft having an inner end and an outer end, the cross-sectional area of the inner end being smaller than the cross-sectional area of the outer end, and the cross-sectional area of the outer end being smaller than the cross-sectional area of the ram;

means for allowing fluid within the ram bore to exert a force upon the cross-sectional area of the outer end of the ram shaft for urging the ram to the closed position;

a piston connected to the ram shaft between the inner and the outer ends;

a housing forming a chamber around the ram shaft between the piston and the inner end of the ram shaft;

means for holding a hydraulic fluid in the chamber until an external signal is received; and means for generating the external signal.

15. A fail-safe blowout preventer, comprising:

a preventer body having a ram bore for guiding a ram between an open and a closed position;

means for allowing fluid within the ram bore to bypass the ram;

a ram shaft having:

an inner end and on outer end, the cross-sectional area of the inner end being smaller than the cross-sectional area of the outer end, and the cross-sectional area of the outer end being smaller than the cross-sectional area of the ram;

an axial bore extending from the ram bore to a first chamber adjacent the outer end of the ram shaft; and a plug slidably mounted in an enlarged portion of the axial bore to seal the axial bore when fluid leaks from the first chamber;

a piston connected to the ram shaft between the inner and the outer ends;

a housing forming a second chamber around the ram shaft between the piston and the inner end of the ram shaft;

means for holding a hydraulic fluid in the second chamber until an external signal is received;

a spring that helps urge the ram to the closed position; and means for generating the external signal.

16. The fail-safe blowout preventer of claim 15, wherein the plug in the axial bore of the ram shaft separates the fluid in the ram bore from a grease in the first chamber.

17. A fail-safe blowout preventer, comprising:

a preventer body having a ram bore for guiding a ram between an open and a closed position;

means for allowing fluid within the ram bore to bypass the ram;

a ram shaft having an inner end and an outer end, the cross-sectional area of the inner end being smaller than the cross-sectional area of the outer end, and the cross-sectional area of the outer end being smaller than the cross-sectional area of the ram;

an axial bore in the ram shaft extending from the ram bore to a chamber adjacent the outer end of the ram shaft;

a plug slidably mounted in an enlarged portion of the axial bore to seal the axial bore when fluid leaks from the chamber; and means for opposing movement of the ram from the open to the closed position until an external signal is received.

18. A fail-safe blowout preventer, comprising:

a preventer body having a ram bore for guiding a ram between an open and a closed position;

means for allowing fluid within the ram bore to bypass the ram;

a ram shaft having an inner end and an outer end, the cross-sectional area of the inner end being smaller than the cross-sectional area of the outer end, and the cross-sectional area of the outer end being smaller than the cross sectional area of the ram;

an axial bore in the ram shaft extending from the ram bore to a second chamber adjacent the outer end of the ram shaft; and a plug slidably mounted in an enlarged portion of the axial bore to seal the axial bore when fluid leaks from the second chamber;

a piston connected to the ram shaft between the inner and outer ends;

a housing forming a chamber around the ram shaft between the piston and the inner end of the ram shaft;

means for holding a hydraulic fluid in the chamber until an external signal is received; and means for generating the external signal.

19. The fail-safe blowout preventer of claim 18, further comprising a spring that rests against the piston to help urge the ram to the closed position.

20. The fail-safe blowout preventer of claim 18, wherein the plug in the axial bore of the ram shaft separates the fluid in the ram bore from a grease in the second chamber.

* * * * *